US012024812B2

(12) United States Patent
Chae et al.

(10) Patent No.: US 12,024,812 B2
(45) Date of Patent: Jul. 2, 2024

(54) CLOTHING MANAGEMENT APPARATUS AND METHOD FOR CONTROLLING SAME

(71) Applicant: SAMSUNG ELECTRONICS CO., LTD., Suwon-si (KR)

(72) Inventors: Gyeongryeol Chae, Suwon-si (KR); Dohaeng Kim, Suwon-si (KR); Dongsuk Kim, Suwon-si (KR); Jewoo Bang, Suwon-si (KR); Donggyu Lee, Suwon-si (KR); Youngdon Jeong, Suwon-si (KR); Juyoung Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 630 days.

(21) Appl. No.: 17/271,063

(22) PCT Filed: Sep. 9, 2019

(86) PCT No.: PCT/KR2019/011622
§ 371 (c)(1),
(2) Date: Feb. 24, 2021

(87) PCT Pub. No.: WO2020/055058
PCT Pub. Date: Mar. 19, 2020

(65) Prior Publication Data

US 2021/0214883 A1 Jul. 15, 2021

(30) Foreign Application Priority Data

Sep. 12, 2018 (KR) ..... 10-2018-0109265

(51) Int. Cl.
*D06F 58/44* (2020.01)
*D06F 34/18* (2020.01)
(Continued)

(52) U.S. Cl.
CPC ..... *D06F 58/44* (2020.02); *D06F 34/18* (2020.02); *D06F 34/26* (2020.02); *D06F 35/00* (2013.01);
(Continued)

(58) Field of Classification Search
CPC ..... D06F 34/18; D06F 58/10; D06F 39/008; D06F 35/00; D06F 58/46; D06F 58/203;
(Continued)

(56) References Cited

U.S. PATENT DOCUMENTS 10,533,277 B2 1/2020 Lyu
2008/0148493 A1 6/2008 Hong et al.
(Continued)

FOREIGN PATENT DOCUMENTS

EP 3748064 A1 * 12/2020 ..... D06F 33/00
JP 2532438 6/1996
(Continued)

OTHER PUBLICATIONS

International Search Report dated Jan. 13, 2020 for International Application No. PCT/KR2019/011622, 4 pages.

*Primary Examiner* — Benjamin L Osterhout
(74) *Attorney, Agent, or Firm* — STAAS & HALSEY LLP

(57) ABSTRACT

Disclosed is a clothing management apparatus. Disclosed clothing management apparatus comprises: memory; a steam generation apparatus for generating steam; a steam discharge member for spraying clothing with the steam generated by the steam generation apparatus; a temperature sensor for sensing the temperature inside the clothing management apparatus; and a processor which, when a clothing management start command is entered, stores the temperature sensed by the temperature sensor in memory, and controls the steam generation apparatus to carry out the
(Continued)

action corresponding to the sensed temperature and clothing management start command, wherein, if an additional clothing management command is entered within a previously set time following an execution of an action corresponding to the clothing management start command, then the processor controls the steam generation apparatus to carry out the action corresponding to the temperature data stored in memory and additional clothing management command.

7 Claims, 8 Drawing Sheets

(51) Int. Cl.

| | |
|---|---|
| ***D06F 34/26*** | (2020.01) |
| ***D06F 35/00*** | (2006.01) |
| ***D06F 39/00*** | (2024.01) |
| ***D06F 39/40*** | (2024.01) |
| ***D06F 58/10*** | (2006.01) |
| ***D06F 58/20*** | (2006.01) |
| ***D06F 58/46*** | (2020.01) |
| ***D06F 73/02*** | (2006.01) |
| *D06F 58/38* | (2020.01) |
| *D06F 103/04* | (2020.01) |
| *D06F 103/08* | (2020.01) |
| *D06F 103/32* | (2020.01) |
| *D06F 103/56* | (2020.01) |
| *D06F 105/12* | (2020.01) |
| *D06F 105/40* | (2020.01) |
| *D06F 105/52* | (2020.01) |
| *D06F 105/56* | (2020.01) |

(52) U.S. Cl.
CPC ..... *D06F 39/40* (2024.01); *D06F 58/10* (2013.01); *D06F 58/203* (2013.01); *D06F 58/46* (2020.02); *D06F 73/02* (2013.01); *D06F 58/38* (2020.02); *D06F 2103/04* (2020.02); *D06F 2103/08* (2020.02); *D06F 2103/32* (2020.02); *D06F 2103/56* (2020.02); *D06F 2105/12* (2020.02); *D06F 2105/40* (2020.02); *D06F 2105/52* (2020.02); *D06F 2105/56* (2020.02)

(58) Field of Classification Search
CPC ..... D06F 58/38; D06F 73/02; D06F 34/26; D06F 58/44; D06F 2105/40; D06F 2103/08; D06F 2103/32; D06F 2103/04; D06F 2105/56; D06F 2105/12; D06F 2105/52; D06F 2103/56; D06F 39/40
See application file for complete search history.

(56) References Cited

U.S. PATENT DOCUMENTS

| | | | | |
|---|---|---|---|---|
| 2018/0202096 | A1* | 7/2018 | Lyu | D06F 58/38 |
| 2020/0071875 | A1* | 3/2020 | Woo | D06F 58/44 |
| 2020/0080251 | A1* | 3/2020 | Chae | D06F 58/10 |

FOREIGN PATENT DOCUMENTS

| | | |
|---|---|---|
| JP | 4091798 | 5/2008 |
| JP | 2009-219582 | 10/2009 |
| JP | 5755036 | 7/2015 |
| KR | 10-0879768 | 1/2009 |
| KR | 10-1155486 | 6/2012 |
| KR | 10-1280378 | 7/2013 |
| KR | 5677825 | 2/2015 |
| KR | 10-1728757 | 4/2017 |
| KR | 10-2018-0057313 | 5/2018 |
| KR | 10-2018-0083540 | 7/2018 |

* cited by examiner

CLOTHING MANAGEMENT APPARATUS AND METHOD FOR CONTROLLING SAME

CROSS-REFERENCE TO RELATED APPLICATIONS

This application is a U.S. National Stage Application, which claims the benefit under 35 U.S.C. § 371 of PCT International Patent Application No. PCT/KR2019/011622, filed Sep. 9, 2019 which claims the foreign priority benefit under 35 U.S.C. § 119 of Korean Patent Application No. 10-2018-0109265, filed Sep. 12, 2018, the contents of which are incorporated herein by reference.

TECHNICAL FIELD

The disclosure relates to a clothing management apparatus and a method for controlling the same, and more particularly to a clothing management apparatus for determining a surrounding temperature of the clothing management apparatus based on whether a consecutive operation of the clothing management apparatus is performed and a method for controlling the same.

BACKGROUND ART

In recent years, as apparatuses for simply treating and managing clothing separately from washing machines, clothing management apparatuses having a function of removing wrinkles of clothing or removing dust or odors through steam have been used.

In the related art, an algorithm for accurately detecting a surrounding temperature of the clothing management apparatus was not applied, and accordingly, even when an internal temperature is increased due to a clothing management operation of the clothing management apparatus, this temperature was recognized as the surrounding temperature, which caused a problem of an abnormal operation occurred when performing an additional clothing management operation.

DISCLOSURE

Technical Problem

An object of the disclosure is to provide a clothing management apparatus for determining a surrounding temperature of the clothing management apparatus based on whether a consecutive operation of the clothing management apparatus is performed and a method for controlling the same.

Technical Solution

According to an aspect of the disclosure, there is provided a clothing management apparatus including a memory, a steam generation device configured to generate steam, a steam discharge member configured to discharge the steam generated by the steam generation device to clothing, a temperature sensor configured to detect a temperature in the clothing management apparatus, and a processor configured to, based on a clothing management start command being input, store the temperature detected by the temperature sensor in the memory, and control the steam generation device to perform an operation according to the detected temperature and the clothing management start command, in which the processor is configured to, based on an additional clothing management command being input within a preset period of time after performing a function according to the clothing management start command, control the steam generation device to perform an operation according to temperature information stored in the memory and the additional clothing management command.

Effect of Invention

BEST MODE

Detailed Description of Exemplary Embodiments

Figure 1:
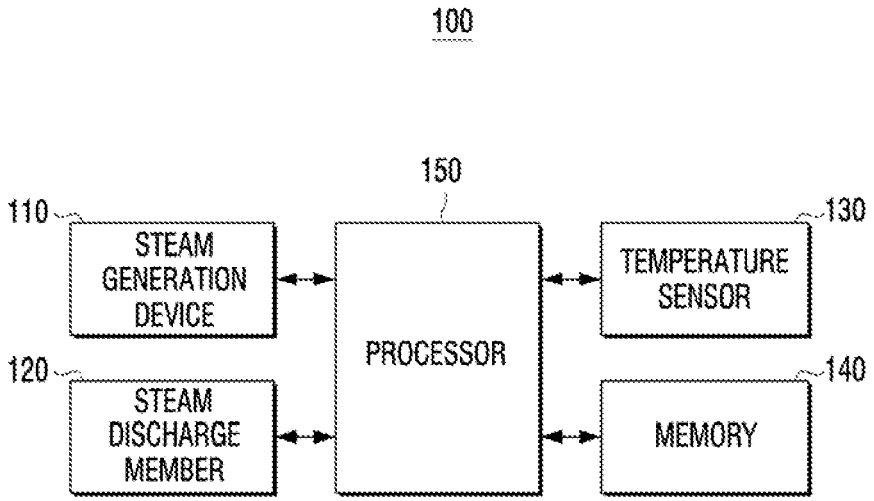
FIG. 1 is a block diagram illustrating a simple configuration of a clothing management apparatus according to an embodiment.

The disclosure will be described in greater detail below after briefly explaining the terms used in the disclosure.

The terms used in embodiments of the disclosure have been selected as widely used general terms as possible in consideration of functions in the disclosure, but these may vary in accordance with the intention of those skilled in the art, the precedent, the emergence of new technologies and the like. In addition, in a certain case, there may also be an arbitrarily selected term, in which case the meaning will be described in the description of the disclosure. Therefore, the terms used in the disclosure should be defined based on the meanings of the terms themselves and the contents throughout the disclosure, rather than the simple names of the terms.

The embodiments of the disclosure may be variously changed and include various embodiments, and specific embodiments will be shown in the drawings and described in detail in the description. However, it should be understood that this is not to limit the scope of the specific embodiments and all modifications, equivalents, and/or alternatives included in the disclosed spirit and technical scope are included. In describing the disclosure, a detailed description of the related art may be omitted when it is determined that the detailed description may unnecessarily obscure a gist of the disclosure.

The terms "first," "second," or the like may be used for describing various elements but the elements may not be limited by the terms. The terms are used only to distinguish one element from another.

Unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

Hereinafter, with reference to the accompanying drawings, embodiments of the disclosure will be described in detail for those skilled in the art to easily practice the embodiments. But, the disclosure may be implemented in various different forms and is not limited to the embodiments described herein. In addition, in the drawings, the parts not relating to the description are omitted for clearly describing the disclosure.

Hereinafter, the disclosure will be described in more detail with reference to the drawings.

FIG. 1 is a block diagram illustrating a simple configuration of a clothing management apparatus according to an embodiment.

Referring to FIG. 1, a clothing management apparatus 100 may be configured with a steam generation device 110, a steam discharge member 120, a temperature sensor 130, a memory 140, and a processor 150.

The steam generation device 110 may generate steam by heating stored water. Specifically, the steam generation device 110 may include a water tank for storing water and may include a heating device for heating the water supplied from the water tank to generate steam. The steam generation device 110 may supply the generated steam to the steam discharge member 120.

The steam discharge member 120 may discharge the steam to an accommodation space in the clothing management apparatus 100. Specifically, the steam discharge member 120 may discharge the high-temperature steam provided from the steam generation device 110 to the accommodation space via a hose to change fabric tissues of the clothing to be soft.

Meanwhile, it is described that the steam generated in the steam generation device 100 is transferred to the steam discharge member 120 via the hose, but in the implementation, the hose may be implemented as various configurations such as a pipe, a flow path, and the like.

The temperature sensor 130 may detect a temperature in the clothing management apparatus 100. Specifically, the temperature sensor 130 may detect a temperature change of the air in the clothing management apparatus 100 by steam or compressed air flowing into the accommodation space of the clothing management apparatus 100 or clothing disposed in the accommodation space. The number of temperature sensors 130 may be more than one.

Meanwhile, the arranged positions of the steam generation device 110, the steam discharge member 120, and the temperature sensor 130 will be described later in detail with reference to FIG. 3.

The memory 140 may store various pieces of data for general operations of the clothing management apparatus 100 such as the programs and the like for treatment or control of the processor 150. Specifically, the memory 140 may store a plurality of application programs operated in the clothing management apparatus 100 and data and instructions for the operation of the clothing management apparatus 100.

The memory 140 may be accessed by the processor 150 and reading, recording, editing, deleting, or updating of the data by the processor 150 may be executed. The memory 140 may be implemented as a removable disk including an external storage medium or a USB memory, a web server via a network, and the like, in addition to the storage medium in the clothing management apparatus 100.

The memory 140 may store information regarding a temperature detected by the temperature sensor 130. Specifically, if a clothing management start command is input, the temperature in the clothing management apparatus 100 detected by the temperature sensor 130 may be stored.

In addition, the memory 140 may store a prestored temperature or a currently detected temperature as a surrounding temperature of the clothing management apparatus by the control of the processor 150. This will be described later in detail with reference to FIG. 4.

The processor 150 may perform the control regarding each configuration in the clothing management apparatus 100. Specifically, the processor 150 may control the operation of the configuration related to a specific function of a plurality of functions of the clothing management apparatus 100. For example, if it is necessary to perform the steaming function, the processor 150 may control the operation of the steam generation device 110 and the steam discharge member 120.

If the clothing management start command is input, the processor 150 may confirm the surrounding temperature of the clothing management apparatus 100 and perform the clothing management operation according to the confirmed surrounding temperature and the input clothing management start command. The reason for that the processor 150 performs the clothing management operation by considering the surrounding temperature will be described hereinafter.

The clothing management apparatus 100 may perform a plurality of functions. For example, the clothing management apparatus 100 may perform the plurality of functions such as heating, steaming, drying, dust removing, and the like. When performing the heating, steaming, or drying function among the plurality of functions, the processor 150 may perform the function by considering an effect of a surrounding environment where the clothing management apparatus 100 is disposed.

Specifically, for the heating, steaming, and drying functions of the clothing management apparatus 100, high-temperature steam or compressed air is used. If the function such as heating, steaming, or drying is performed while the clothing management apparatus 100 is installed in an environment at a low temperature, thermal expansion may occur due to a difference in temperature from the surrounding environment of the clothing management apparatus 100, even if the high-temperature steam or compressed air is discharged into the accommodation space in the clothing management apparatus 100. Accordingly, the temperature of the accommodation space in the clothing management apparatus 100 may not reach a target temperature, and thus the original effect of the function of the clothing management apparatus 100 may not be exhibited.

As described above, the processor 150 should perform the clothing management operation by considering the thermal expansion due to the effect of the surrounding environment of the clothing management apparatus 100, and accordingly, the processor 150 may confirm the surrounding temperature of the clothing management apparatus 100 and perform the clothing management operation according to the confirmed surrounding temperature and the input clothing management start command.

The processor 150 may determine the current surrounding temperature of the clothing management apparatus 100 as one of the temperature detected through the temperature sensor 130 and the surrounding temperature prestored in the memory 140.

Specifically, if the clothing management start command is input, the processor 150 may confirm whether the clothing management apparatus 100 performs the clothing management operation consecutively, if the clothing management apparatus does not perform the clothing management operation consecutively, the processor 150 may determine the temperature detected via the temperature sensor 130 as a current surrounding temperature, and if the clothing management apparatus performs the clothing management operation consecutively, the processor 150 may determine the surrounding temperature prestored in the memory 140 as the current surrounding temperature.

Meanwhile, the operation of determining the surrounding temperature of the clothing management apparatus 100 by confirming whether the clothing management apparatus 100 performs the clothing management operation consecutively will be described later in detail with reference to FIG. 4.

The processor 150 may control the clothing management operation differently according to whether the determined surrounding temperature corresponds to a preset range.

Specifically, as described above about the reason for that the processor 150 performs the clothing management operation by considering the surrounding temperature, the effect of the function of the clothing apparatus 100 may be changed due to the effect of the surrounding environment. Accordingly, if the surrounding temperature corresponds to a preset range, the processor 150 may perform the clothing management operation by using preset setting information, and if the surrounding temperature is lower than the preset range, the processor 150 may perform the clothing management operation by using separate low temperature setting information.

The preset range herein may be a temperature range including room temperature and may be a temperature range of 15 degrees or higher. Meanwhile, the preset range may be not limited to the example described above.

The low temperature setting information herein may be control information set so as to be suitable to a situation where the clothing management apparatus 100 is operated at a low temperature, and may include information such as starting pattern of a compressor of the steam generation device 110, a steam temperature of the steam generation device 110, a target temperature in the clothing management apparatus 100, or the like. Meanwhile, the low temperature setting information is not limited to the example described above.

For example, if the surrounding temperature is detected as 10 degrees, the processor 150 may perform the clothing management operation by using the low temperature setting information, not the preset information, and if the surrounding temperature is detected as 25 degrees, the processor 150 may perform the clothing management operation by using the preset information.

Meanwhile, only the simple configuration of the clothing management apparatus is illustrated and described hereinabove, but in the implementation, various configurations may be additionally provided. This will be described below with reference to FIG. 2.

Figure 2:
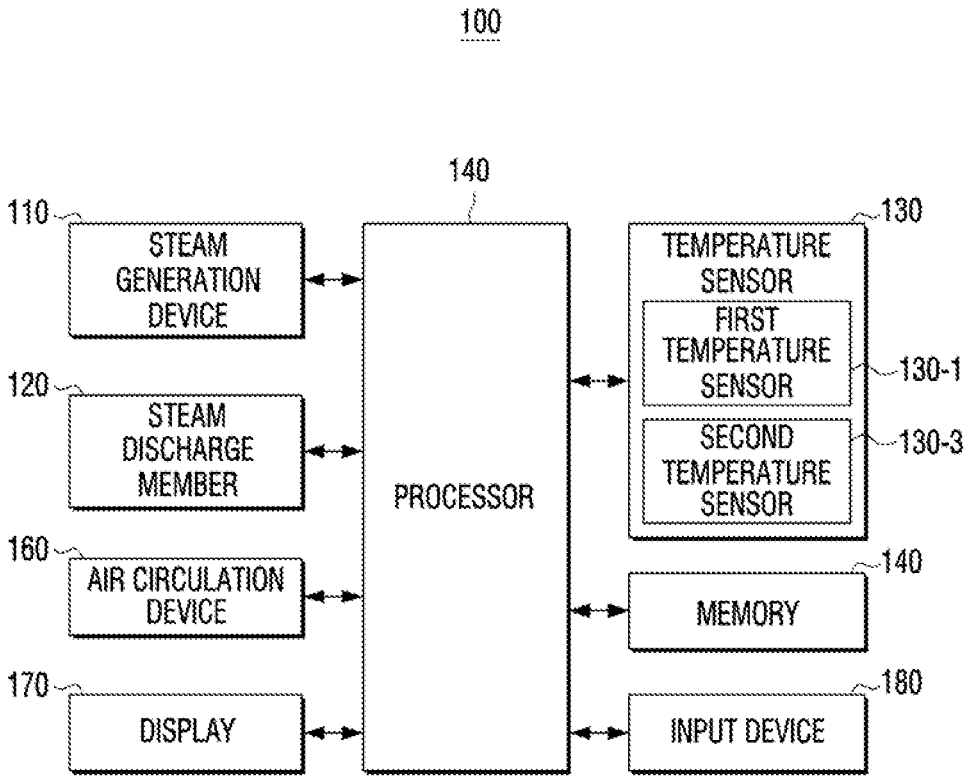
FIG. 2 is a block diagram illustrating a specific configuration of a clothing management apparatus according to an embodiment.

FIG. 2 is a block diagram illustrating a specific configuration of a clothing management apparatus according to an embodiment.

Referring to FIG. 2, the clothing management apparatus 100 may be configured with the steam generation device 110, the steam discharge member 120, the temperature sensor 130, the memory 140, the processor 150, an air circulation device 160, a display 170, and an input device 180.

The steam generation device 110, the steam discharge member 120, the temperature sensor 130, the memory 140, and the processor 150 perform the same functions as the configuration of FIG. 1, and therefore the overlapped description thereof will not be repeated.

The air circulation device 160 may compress the air in the accommodation space of the clothing management apparatus 100 to generate the high-temperature air. The air circulation device 160 may dry the clothing by discharging the compressed high-temperature air to the accommodation air again and such circulation of the air may be periodically repeated.

The air circulation device 160 may include a compressor for compressing the air, a fan for moving the air, and a refrigerant for providing heat to the air. In addition, the air circulation device 160 may include an inflow part to which the air in the air accommodation space of the clothing management apparatus 100 flows, and a discharge part for discharging the air into the accommodation space. A first temperature sensor 130-1 may be disposed on the inflow part of the air circulation device 160 and a second temperature sensor 130-3 may be disposed on the discharge part thereof, and accordingly, temperatures of the air flowing into or discharged from the air circulation device 160 may be detected.

The processor 150 may determine a dried state of the clothing in the accommodation space by using a difference between temperatures detected by the plurality of temperature sensors 130-1 and 130-3 disposed on the air circulation device 160. Specifically, the processor 150 may determine the dried state of the clothing in the accommodation space by using the difference of temperatures detected by the first temperature sensor 130-1 and the second temperature sensor 130-3.

In general, the dried state of the clothing may be determined using a load size of the clothing. Specifically, if the clothing contains a large amount of moisture, the load size of the clothing is large, and if the clothing contains a small amount of moisture, the load size of the clothing is small, and accordingly, the dried state of the clothing may be determined when the information regarding the load size of the clothing is obtained.

Accordingly, if the clothing management apparatus 100 includes a touch sensor (not illustrated), the processor 150 may detect the load size of the clothing directly by using the touch sensor.

On the other hand, if the touch sensor is not included, the processor 150 may calculate the load size of the clothing indirectly by using temperatures detected by the plurality of temperature sensors 130-1 and 130-3. The processor 150 may determine the dried state of the clothing based on the calculated load size.

Meanwhile, the operation in which the processor 150 detects the load size of the clothing indirectly by using the temperatures detected by the plurality of temperature sensors 130-1 and 130-3 and determines the dried state of the clothing based on the detected load size will be described later in detail with reference to FIG. 5.

In addition, the processor 150 may adjust an operation time of the clothing management operation based on the dried state of the clothing. Specifically, the processor 150 may reduce or increase the operation time of the drying function of the clothing management apparatus 100 based on the dried state of the clothing.

For example, if it is determined that the clothing contains a large amount of moisture, the processor 150 may increase the operation time of the drying function, and if it is determined that the clothing contains a small amount of moisture, the processor 150 may reduce the operation time of the drying function.

Meanwhile, the function having the operation time adjusted based on the dried state of the clothing is not limited to the drying function.

The display 170 may display various pieces of information provided by the clothing management apparatus 100. Specifically, the display 170 may display a user interface window for selecting various functions provided by the clothing management apparatus 100.

The display 170 may be a monitor such as an LCD, a CRT, or an OLED and may also be implemented as a touch screen for simultaneously performing functions of receiving selection of a function and receiving a control command of the corresponding function from a user.

The input device 180 may receive selection of a function and a control command of the corresponding function from the user. The function herein may include heating, steaming, drying, dust removing functions, and the like. The input device 180 may receive the control command via a control menu displayed on the display 170.

The input device 180 may be implemented as a plurality of buttons, a keyboard, a mouse, or the like and may also be implemented as a touch screen for simultaneously performing the function of the display 170.

As described above, the clothing management apparatus according to an embodiment may determine the surrounding temperature of the clothing management apparatus by using the temperature sensor provided in the clothing management apparatus, although the temperature sensor is not provided outside of the clothing management apparatus, and therefore, the effect of cost reduction is exhibited.

In addition, the clothing management operation is differently performed according to the value of the surrounding temperature, and therefore, the targeted effect of the original function may be exhibited regardless of the effect of the surrounding environment.

In addition, although the touch senor is not provided, the dried state of the clothing may be determined by using the temperature sensor provided in the clothing temperature apparatus, and therefore the effect of cost reduction is exhibited.

Figure 3:
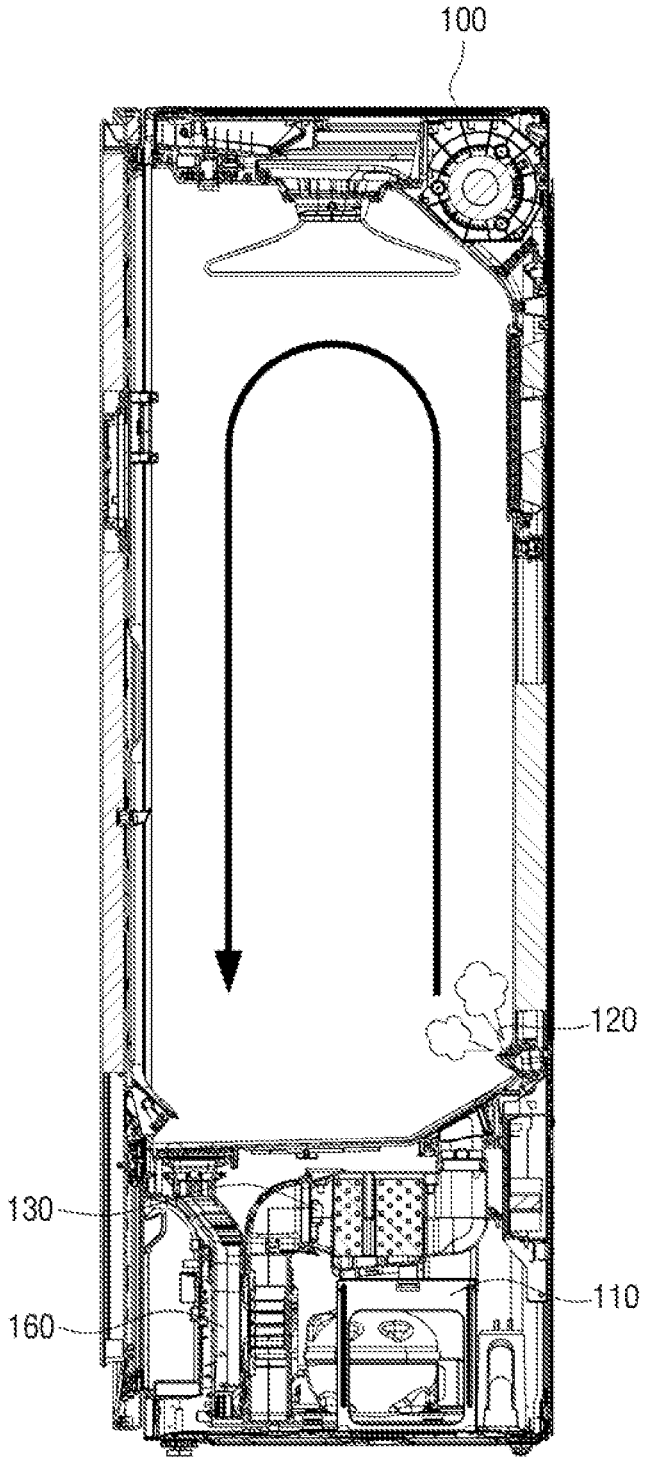
FIG. 3 is a front view of a clothing management apparatus according to an embodiment.

FIG. 3 is a front view of a clothing management apparatus according to an embodiment.

Referring to FIG. 3, the specific arrangement positions of the steam generation device 110, the steam discharge member 120, the temperature sensor 130, and the air circulation device 160 may be confirmed.

First, a clothing support device in a hanger shape may be disposed on an upper portion of the accommodation space in the clothing management apparatus 100. The user may use the clothing management apparatus 100 while clothing is supported and fixed by the clothing support device.

The steam generation device 110 may be disposed on a lower portion of the accommodation space in the clothing management apparatus 100. In addition, the steam generation device 110 and the steam discharge member 120 may be connected to each other via a hose. The steam discharge member 120 may receive steam generated by the steam generation device 110 via a hose and discharge the steam towards the clothing disposed in the accommodation space in the clothing management apparatus 100.

The steam discharge member 120 may be disposed at one side surface of the accommodation space in the clothing management apparatus 100 and installed to be movable vertically, thereby spraying the steam evenly while moving vertically.

Meanwhile, the installation position of the steam discharge member 120 is not limited to the above example.

Meanwhile, if the hose of the steam discharge member 120 is detached, the steam generated in the steam generation device 110 may leak to the air circulation device 160, internal circuits, or electronic components positioned at a lower end of the accommodation space or leak to the outside of the clothing management apparatus 100. The leaked steam may cause damage on the clothing management apparatus 100.

The temperature sensor 130 may be disposed on one side surface of the accommodation space in the clothing management apparatus 100 to detect the temperature change of the air of the accommodation space. In addition, the clothing management apparatus 100 may comprise a plurality of temperature sensors 130 and the plurality of temperature sensors 130-1 and 130-3 may be disposed on the inflow part and the discharge part of the air circulation device 160, respectively, thereby detecting the temperature change of the air flowing to or discharged from the air circulation device 160.

Meanwhile, the installation position of the temperature sensors 130 is not limited to the above example, as long as they are disposed at positions where the temperature in the clothing management apparatus 100 is detectable.

The air circulation device 160 may be disposed at a lower portion of the accommodation space in the clothing management apparatus 100. The air circulation device 160 may include an inflow port to which the air in the air accommodation space flows, and a discharge port for discharging the air to the accommodation space. Referring to FIG. 3, the air circulation device 160 may circulate the air via the inflow port and the discharge port along a direction of an arrow.

The clothing management apparatus 100 may perform preset functions for clothing management by using the steam generation device 110, the steam discharge member 120, and the air circulation device 160 while the clothing is supported or fixed by the clothing support device.

For example, the clothing management apparatus 100 may perform the clothing management operation in the order of heating, steaming, drying, and dust removing by using the steam generation device 110, the steam discharge member 120, and the air circulation device 160.

The heating function herein may be a function of causing high-temperature air to flow into the accommodation space by using the air circulation device 160 disposed on the lower portion of the accommodation space and allowing the flowed high-temperature air to change the fabric tissues of the clothing to be soft. As the fabric tissues of the clothing changes into a soft state, an effect of the steaming function performed thereafter may be increased.

In addition, the steaming function may be a function of spraying the high-temperature steam to the clothing by using the steam generation device 110 and the steam discharge member 120 and a function of applying a pressure to a front surface or a rear surface of the clothing. By doing so, the clothing may be compressed. The steam discharge member 120 may be disposed on one side surface of the accommodation space to spray the steam or compressed air to the clothing while moving vertically.

In addition, the drying function may be a function of removing the moisture remaining in the clothing by flowing the high-temperature air into the accommodation space by using the air circulation device 160.

Further, the dust removing function may be a function of removing dust attached to the clothing by spraying high-pressure air by a spraying device connected to the air support device disposed on an upper end of the accommodation space.

Meanwhile, the functions used for performing the clothing management operation by the clothing management apparatus 100 are not limited to the heating, steaming, drying, and dust removing functions and the method for performing the above functions are not limited to the above examples.

Meanwhile, in illustrating and describing FIG. 3, it is illustrated and described that one steam generation device, one steam discharge member, and one air circulation device are provided, but in the implementation, a plurality of steam generation devices, a plurality of steam discharge members, and a plurality of air circulation devices may be provided.

In addition, in illustrating and describing FIG. 3, it is illustrated and described that the clothing support device has a shape of a normal hanger, but it is no limitation thereto in the implementation, as long as it has a shape capable of supporting clothing.

Figure 4:
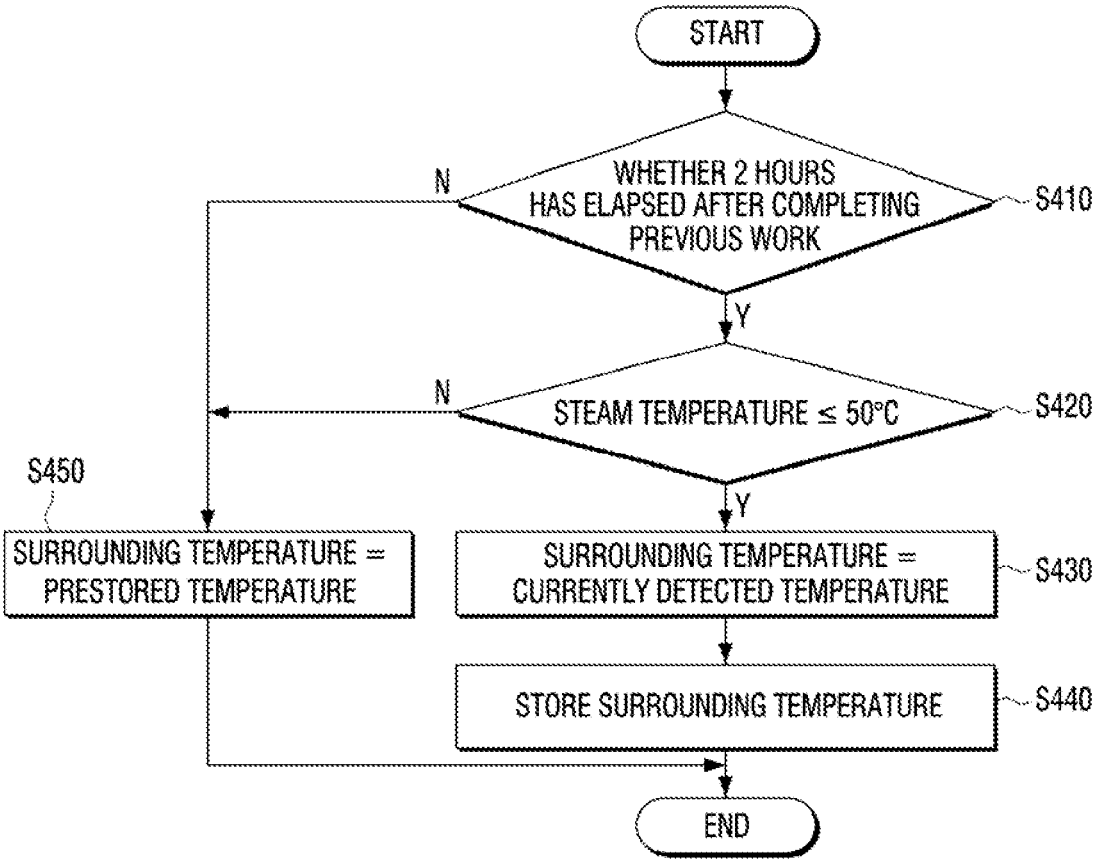
FIG. 4 is a flowchart illustrating a surrounding temperature determination method of a clothing management apparatus according to an embodiment.

FIG. 4 is a flowchart illustrating a surrounding temperature determination method of a clothing management apparatus according to an embodiment.

Referring to FIG. 4, an operation of determining the surrounding temperature of the clothing management apparatus 100 by confirming whether the clothing management apparatus 100 consecutively performs the clothing management operation may be confirmed.

If the temperature sensor is provided outside of the clothing management apparatus 100, the processor 150 may recognize a temperature detected by the external temperature sensor as the surrounding temperature of the clothing management apparatus 100.

On the other hand, if the temperature sensor is not provided outside of the clothing management apparatus 100, the processor 150 may recognize a surrounding temperature of the clothing management apparatus 100 by using the temperature sensor 130 disposed in the condition management apparatus 100.

Specifically, if the clothing management apparatus 100 does not perform the clothing management operation during a sufficient period of time, a temperature in the clothing management apparatus 100 detected by the temperature sensor 130 may be the same as the surrounding temperature of the clothing management apparatus 100 due to thermal expansion.

Accordingly, although a separate temperature sensor capable of detecting an external temperature is not provided on the clothing management apparatus 100, the processor 150 may detect the surrounding temperature by using the temperature sensor 130 provided in the clothing management apparatus 100. The processor 150 may store the temperature detected by the temperature sensor 130 in the memory 140 as the surrounding temperature.

Meanwhile, after the clothing management apparatus 100 performs the clothing management operation, a command for an additional clothing management operation may be input before a sufficient period of time for the thermal expansion is elapsed. At that time, the inner temperature of the clothing management apparatus 100 may have a high value due to the high-temperature steam or the compressed air discharged in the clothing management operation performed previously and this may have a large different from the actual surrounding temperature of the clothing management apparatus 100.

In this case, the processor 150 may determine the prestored surrounding temperature information as the surrounding temperature of the clothing management apparatus 100, rather than the temperature detected by the temperature sensor 130. In addition, the processor 150 may not perform the operation of storing the temperature detected by the temperature sensor 130 in the memory 140 as the surrounding temperature.

The prestored surrounding temperature information herein may be temperature information determined as the surrounding temperature and stored in the memory 140 by the processor 150 when performing the previous clothing management operation. If the clothing management apparatus 100 is initially operated, the prestored surrounding temperature may be a temperature set as default at the time of shipping.

As described above, although there is no external temperature sensor of the clothing management apparatus 100, the processor 150 may determine the surrounding temperature by using the temperature sensor 130 disposed in the clothing management apparatus 100 and determine whether the clothing management apparatus 100 consecutively performs the clothing management operation, in order to determine the surrounding temperature.

Specifically, if the clothing management start command is input, the processor 150 may confirm whether a preset condition is satisfied and determine whether the clothing management apparatus 100 consecutively performs the clothing management operation.

The preset condition herein may refer to a state where it is determined that a sufficient period of time has elapsed for thermal expansion from the previous clothing management operation. For example, the state may be a state where 120 minutes has passed from the point when the previous clothing management operation has performed, or a state where a temperature of water stored in the water tank of the steam generation device 110 is 50 degrees or lower, and is not limited to the above examples.

When the preset condition is satisfied, the processor 150 may determine the temperature detected by the temperature sensor 130 as the surrounding temperature, and when the preset condition is not satisfied, the processor 150 may determine the prestored surrounding temperature as the surrounding temperature.

Hereinafter, an embodiment of the operation in which the processor 150 determines the surrounding temperature of the clothing management apparatus 100 by confirming whether the clothing management operation 100 consecutively performs the clothing management operation will be described.

First, the processor 150 may confirm whether 2 hours has elapsed after completion of the previous clothing management operation (S410).

If 2 hours has elapsed after completion of the previous clothing management operation (S410—Y), the processor 150 may confirm whether the temperature of the water stored in the water tank of the steam generation device 110 is 50 degrees or lower (S420).

If the temperature of the water stored in the water tank of the steam generation device 110 is 50 degrees or lower (S420—Y), the processor 150 may determine that the clothing management apparatus 100 does not consecutively perform the clothing management operation and recognize the temperature detected by the temperature sensor 130 as the surrounding temperature of the clothing management apparatus 100 (S430).

Meanwhile, the steps S410 and S420 described above are an embodiment for determining whether the clothing management apparatus 100 consecutively performs the clothing management operation and the method for determining whether the clothing management apparatus 100 consecutively performs the clothing management operation is not limited to the above example.

The processor 150 may store the temperature detected by the temperature sensor 130 in the memory 140 as the surrounding temperature of the clothing management apparatus 100 (S440).

On the other hand, when 2 hours has not elapsed after the completion of the previous clothing management operation (S410—N) or when the temperature of the water stored in the water tank of the steam generation device 110 exceeds 50 degrees (S420—N), the processor 150 may determine that the clothing management apparatus 100 consecutively performs the clothing management operation and recognize the surrounding temperature prestored in the memory 140 as the current surrounding temperature of the clothing management apparatus 100 (S450).

Meanwhile, in illustrating and describing FIG. 4, it is illustrated and described that the steps S410 and S420 proceed in sequence, but in the implementation, the order of both steps may change and one of the two steps may not be performed.

Figure 5:
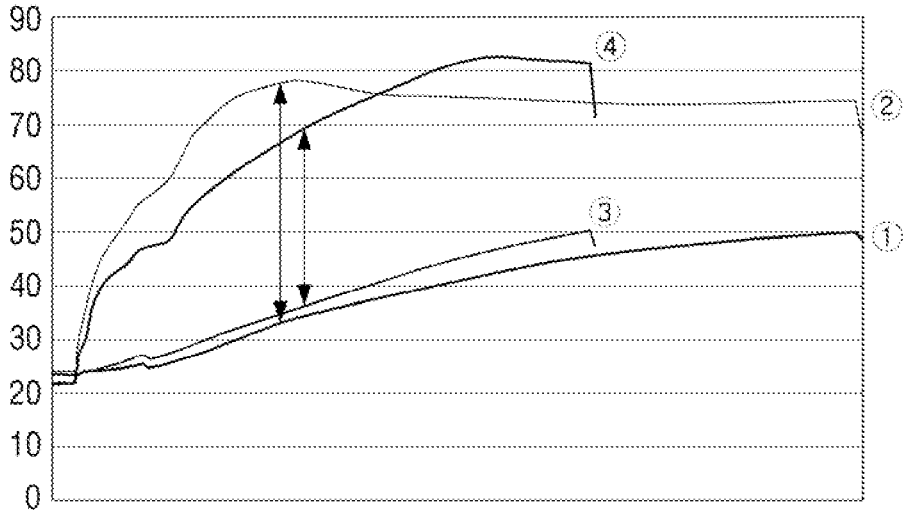
FIG. 5 is a diagram illustrating a method for determining a dried state of clothing by using a detected temperature.

FIG. 5 is a diagram illustrating a method for determining a dried state of clothing by using a detected temperature.

Referring to FIG. 5, a temperature ① detected by the first temperature sensor 130-1 and a temperature ② detected by the second temperature sensor 130-3, in a case where clothing with a large load size is accommodated, may be confirmed. In addition, a temperature ③ detected by the first temperature sensor 130-1 and a temperature ④ detected by the second temperature sensor 130-3, in a case where clothing with a small load size is accommodated, may be confirmed.

The processor 150 may calculate the load size of the clothing by using the difference between temperatures detected by the first temperature sensor 130-1 and the second temperature sensor 130-3 and determine the dried state of the clothing in the accommodation space based on the calculated load size.

Specifically, the first temperature sensor 130-1 and the second temperature sensor 130-3 may be disposed on the inflow part and the discharge part of the air circulation device 160, respectively, thereby detecting the temperature of the air flowing in and discharged from the air circulation device 160.

Accordingly, the second temperature sensor 130-3 may detect a high temperature due to the high-temperature air discharged from the discharge part. In addition, the first temperature sensor 130-1 may detect a low temperature, since the air, which has transferred heat to the clothing, flows in via the inflow part. Therefore, there is a difference between temperatures detected by each of the first temperature sensor 130-1 and the second temperature sensor 130-3.

The difference between temperatures detected by the first temperature sensor 130-1 and the second temperature sensor 130-3 may correspond to the load size of the clothing.

Specifically, the large load size of the clothing may imply that the clothing contains a large amount of moisture, and accordingly, when the load size of the clothing is large, the high-temperature air discharged from the air circulation device 160 may provide a large amount of heat to the moisture contained in the clothing. Therefore, there is a large difference between the temperature ① detected by the first temperature sensor 130-1 and the temperature ② detected by the second temperature sensor 130-3.

On the other hand, the small load size of the clothing may imply that the clothing contains a small amount of moisture, and accordingly, when the load size of the clothing is small, the high-temperature air discharged from the air circulation device 160 may provide a small amount of heat to the moisture contained in the clothing. Therefore, there is a small difference between the temperature ③ detected by the first temperature sensor 130-1 and the temperature ④ detected by the second temperature sensor 130-3.

Based on the above features, the processor 150 may calculate the load size of the clothing using the difference between temperatures detected by the first temperature sensor 130-1 and the second temperature sensor 130-3. When the calculated load size is large, the processor 150 may determine that the clothing contains a large amount of moisture, when the calculated load size is small, the processor 150 may determine that the clothing contains a small amount of moisture.

When using the temperatures detected by using the plurality of temperature sensors 130-1 and 130-3, the processor 150 may use the temperature detected during a preset period of time after the clothing management operation start of the clothing management apparatus 100. The processor 150 may calculate the load size of the clothing based on the temperature information detected during the preset period of time.

For example, the processor 150 may calculate the load size of the clothing by using the temperature information detected by the plurality of temperature sensors 130-1 and 130-3 for 40 minutes after starting the clothing management operation.

In addition, when detecting the temperatures by using the plurality of temperature sensors 130-1 and 130-3, the processor 150 may detect the temperature until one temperature sensor of the plurality of temperature sensors 130-1 and 130-3 obtains a preset temperature value after starting the clothing management operation of the clothing management apparatus 100.

For example, the processor 150 may calculate the load size of the clothing by using the temperature information detected by the plurality of temperature sensors 130-1 and 130-3 until the temperature detected by the first temperature sensor 130-1 reaches 40 degrees after starting the clothing management operation.

In addition, in order to improve accuracy, the processor 150 may calculate the load size corresponding to a largest difference value from among the differences between the temperatures detected by the first temperature sensor 130-1 and the second temperature sensor 130-3 and determine a dried state of the clothing based on the calculated load size. The memory 140 may store information regarding the load size corresponding to the difference value of the temperatures.

In addition, the processor 150 may adjust an operation time of the clothing management operation based on the dried state of the clothing. Specifically, the processor 150 may reduce or increase the operation time of the drying function of the clothing management apparatus 100 based on the dried state of the clothing.

For example, when it is determined that the clothing contains a large amount of moisture, the processor 150 may increase the operation time of the drying function, and when it is determined that the clothing contains a small amount of moisture, the processor 150 may reduce the operation time of the drying function.

Meanwhile, a case where the calculated load size is small may correspond to a case where the clothing disposed in the accommodation space contains a small amount of moisture as described above. However, in addition to this, it may correspond to a case where the calculated load size has a small value due to the small size of the clothing itself, although the clothing disposed in the accommodation space is totally wet. For example, if a wet handkerchief is disposed in the accommodation space, the calculated load size may be small.

Accordingly, when the calculated load size is small, the processor 150 may determine that the clothing contains a small amount of moisture and reduce the operation time of the drying function, but may not reduce the operation time of the drying function to the preset time or shorter, in order to achieve the original object of the drying function, even when the small-sized clothing described above is disposed in the accommodation space.

For example, if the calculated load size is small, the processor 150 may reduce the operation time of the drying function, but control the entire operation time of the drying function not to be reduced to 50 minutes or shorter.

Meanwhile, the function for adjusting the operation time based on the dried state of the clothing is not limited to the drying function.

Figure 6:
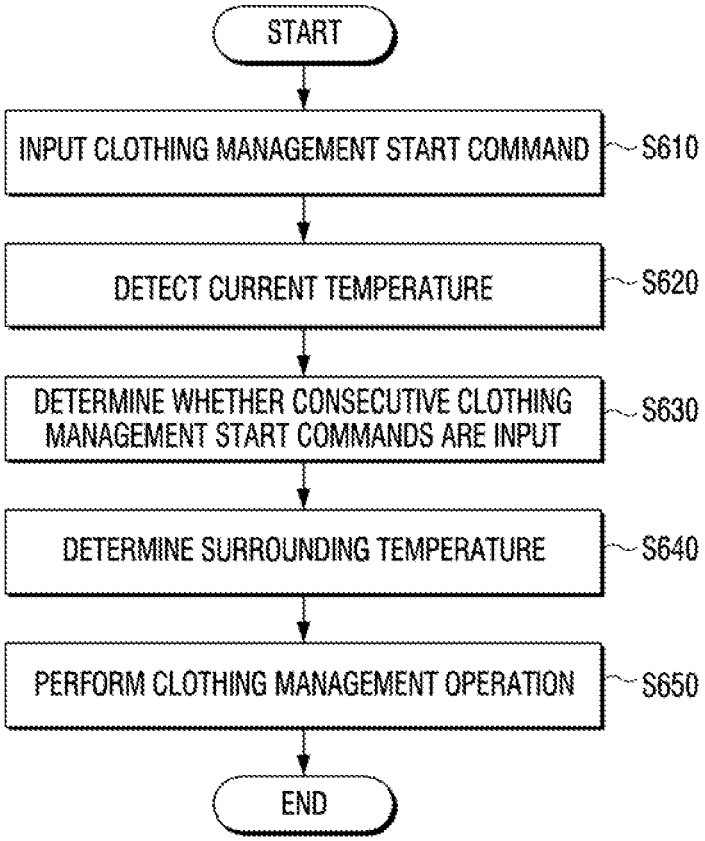
FIG. 6 is a flowchart illustrating a method for controlling a clothing management apparatus according to an embodiment.

FIG. 6 is a flowchart illustrating a method for controlling a clothing management apparatus according to an embodiment.

Referring to FIG. 6, first, the clothing management start command may be input (S610). Specifically, one function from among a plurality of functions such as heating, steaming, drying, and dust removing of the clothing management apparatus may be selected and a control command regarding the selected function may be input.

A temperature in the clothing management apparatus may be detected via the temperature sensor (S620).

It may be determined whether the clothing management start command is consecutively input (S630). Specifically, it may be confirmed whether the clothing management start command is input within a preset period of time from the completion of the previous clothing management operation. Alternatively, it may be confirmed whether a temperature of water stored in a water tank of the steam generation device has a preset temperature value or lower.

A surrounding temperature may be determined according to whether the clothing management start command is consecutively input (S640). When it is determined that the input clothing management start command is consecutively input, a prestored surrounding temperature may be determined as a current surrounding temperature. On the other hand, when it is determined that the input clothing management start command is not consecutively input, a temperature detected by the temperature sensor may be determined as the current surrounding temperature.

In addition, the determined surrounding temperature may be stored as the surrounding temperature of the clothing management apparatus in the memory.

Further, the clothing management operation may be performed based on the determined surrounding temperature and the input clothing management start operation (S650).

Therefore, in the method for controlling the clothing management apparatus of the disclosure, although the temperature sensor is not provided outside of the clothing management apparatus, the accurate surrounding temperature of the clothing management apparatus may be determined by using the temperature sensor provided in the clothing management apparatus, and accordingly, an effect of cost reduction and an effect of preventing abnormal operation occurrence may be exhibited. The control method of FIG. 6 may be executed on the clothing management apparatus having the configuration of FIG. 1 or FIG. 2, and may also be executed on a clothing management apparatus having other configurations.

In addition, the control method described above may be implemented as at least one execution program for executing the control method described above and such an execution program may be stored in a non-transitory computer-readable medium.

The non-transitory computer-readable medium is not a medium storing data for a short period of time such as a register, a cache, or a memory, but may refer to a medium that semi-permanently stores data and is readable by a machine. Specifically, the various applications or programs described above may be stored and provided to the non-transitory computer-readable medium such as a CD, a DVD, a hard disk drive, a Blu-ray disc, a USB, a memory card, and a ROM.

Figure 7:
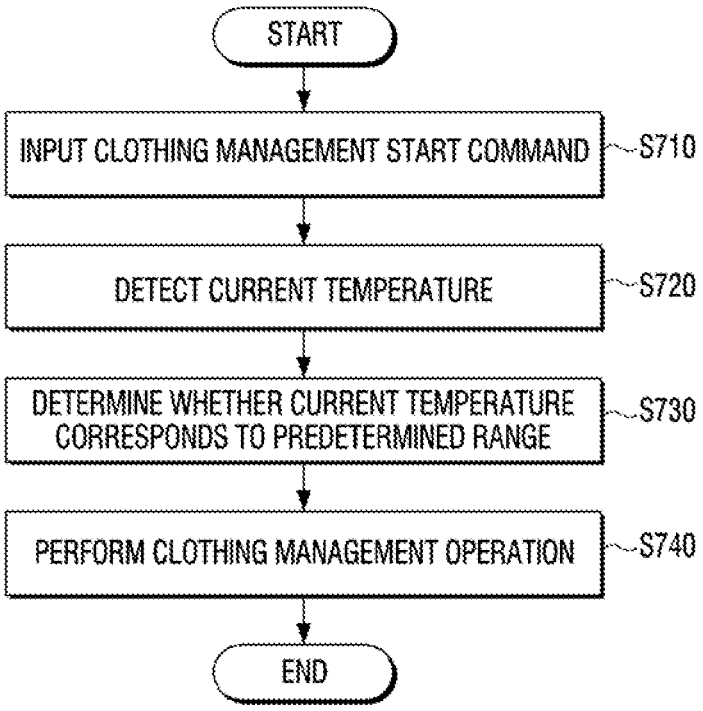
FIG. 7 is a flowchart illustrating a method for controlling a clothing management apparatus at the time of low temperature detection according to an embodiment.

FIG. 7 is a flowchart illustrating a method for controlling a clothing management apparatus at the time of low temperature detection according to an embodiment.

Referring to FIG. 7, first, the clothing management start command may be input (S710). Specifically, one function from among a plurality of functions such as heating, steaming, drying, and dust removing of the clothing management apparatus may be selected and a control command regarding the selected function may be input.

A temperature in the clothing management apparatus may be detected by using the temperature sensor (S720). Meanwhile, when the clothing management start command is input, if the clothing management apparatus consecutively performs the clothing management operation, the prestored temperature may be imported.

It may be determined whether the detected temperature corresponds to a preset range (S730). The preset range herein may be a temperature range including room temperature and may be a temperature range of 15 degrees or higher. Meanwhile, the preset range is not limited to the above examples.

Meanwhile, when it is determined that the clothing management apparatus consecutively performs the clothing management operation in the step S720 and the prestored temperature is imported, it may be determined whether the prestored temperature corresponds to the preset range.

In addition, the clothing management operation may be performed based on a determination result regarding whether the detected temperature corresponds to the preset range and the clothing management start command (S740).

Specifically, if the detected temperature corresponds to the preset range, the clothing management operation may be performed by using the preset setting information, and if the detected temperature is lower than the preset range, the clothing management operation may be performed by using separate low temperature setting information.

The low temperature setting information herein may be control information set so as to be suitable to a situation where the clothing management apparatus 100 is operated at a low temperature, and may include information such as starting pattern of a compressor of the steam generation device 110, a steam temperature of the steam generation device 110, a target temperature in the clothing management apparatus 100, or the like. Meanwhile, the low temperature setting information is not limited to the example described above.

Therefore, in the control method of the clothing management apparatus of the disclosure, an effect of controlling the original function to exhibit the targeted effect, regardless of the effect of the surrounding environment, may be exhibited, by differently performing the clothing management operation according to the value of the detected temperature. The control method of FIG. 7 may be executed on the clothing management apparatus having the configuration of FIG. 1 or FIG. 2, and may also be executed on a clothing management apparatus having other configurations.

In addition, the control method described above may be implemented as at least one execution program for executing the control method described above and such an execution program may be stored in a non-transitory computer-readable medium.

Figure 8:
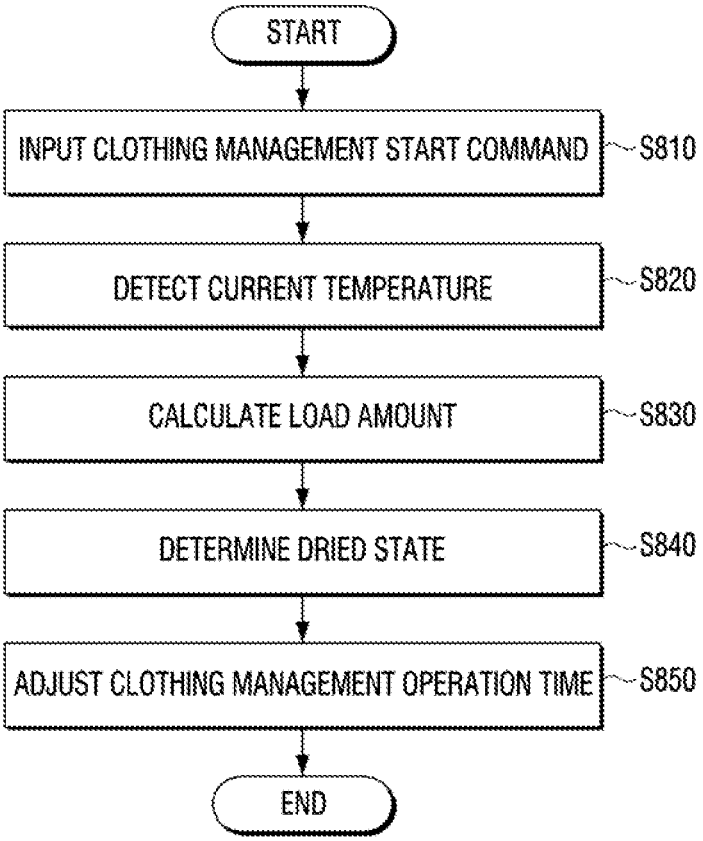
FIG. 8 is a flowchart illustrating a method for controlling a clothing management apparatus using a load size in a clothing management apparatus according to an embodiment.

FIG. 8 is a flowchart illustrating a method for controlling a clothing management apparatus using a load size in a clothing management apparatus according to an embodiment.

Referring to FIG. 8, first, the clothing management start command may be input (S810). Specifically, one function from among a plurality of functions such as heating, steaming, drying, and dust removing of the clothing management apparatus may be selected and a control command regarding the selected function may be input.

A temperature in the clothing management apparatus may be detected by using the temperature sensor (S820). Specifically, the temperature in the clothing management apparatus may be detected by using the plurality of temperature sensors disposed at different positions in the clothing management apparatus. The plurality of temperature sensors may be disposed on the inflow part and the discharge part of the air circulation device, respectively.

When detecting the temperatures by using the plurality of temperature sensors, the temperature may be detected during the preset period of time or the temperature may be detected until one temperature sensor of the plurality of temperature sensor obtains a preset temperature value.

A load amount of the clothing in the clothing management apparatus may be calculated using the temperatures detected by the plurality of temperature sensors (S830). Specifically, the load amount of the clothing may be calculated based on a difference between temperatures detected by the plurality of temperature sensors. More specifically, a load size corresponding to a largest difference value among the differences between temperatures detected by the plurality of temperature sensors may be calculated.

The dried state of the clothing in the clothing management apparatus may be determined by using the calculated load amount (S840). Specifically, if the calculated load size is large, it may be determined that the clothing contains a large amount of moisture, and if the calculated load size is small, it may be determined that the clothing contains a small amount of moisture.

The operation time of the clothing management operation may be adjusted based on the dried state of the clothing (S850). Specifically, the operation time of the drying function of the clothing management apparatus 100 may be reduced or increased based on the dried state of the clothing.

For example, if it is determined that the clothing contains a large amount of moisture, the operation time of the drying function may be increased, and if it is determined that the clothing contains a small amount of moisture, the operation time of the drying function may be reduced.

Meanwhile, a case where the calculated load size is small in the step S840 may correspond to a case where the clothing disposed in the accommodation space contains a small amount of moisture as described above. However, in addition to this, it may correspond to a case where the calculated load size has a small value due to the small size of the clothing itself, although the clothing disposed in the accommodation space is totally wet. For example, if a wet handkerchief is disposed in the accommodation space, the calculated load size may be small.

Accordingly, when the calculated load size is small, the operation time of the drying function may be reduced by determining that the clothing contains a small amount of moisture, but the operation time of the drying function may not be reduced to the preset time or shorter, in order to achieve the original object of the drying function, even when the small-sized clothing described above is disposed in the accommodation space.

For example, if the calculated load size is small, the operation time of the drying function may be reduced, but the entire operation time of the drying function may be controlled not to be reduced to 50 minutes or shorter.

Meanwhile, in illustrating and describing FIG. 8, it is illustrated and described that the dried state of the clothing is determined by using the load size calculated in the step S840, but in the implementation, the operation time of the drying function may be adjusted by using only the calculated load size.

Therefore, in the method for controlling the clothing management apparatus of the disclosure, although the touch sensor is not provided, the dried state of the clothing may be determined by using the temperature sensors provided in the clothing management apparatus, thereby exhibiting the effect of cost reduction. The control method of FIG. 8 may be executed on the clothing management apparatus having the configuration of FIG. 1 or FIG. 2, and may also be executed on a clothing management apparatus having other configurations.

In addition, the control method described above may be implemented as at least one execution program for executing the control method described above and such an execution program may be stored in a non-transitory computer-readable medium.

While preferred embodiments of the disclosure have been shown and described, the disclosure is not limited to the aforementioned specific embodiments, and it is apparent that various modifications can be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

INDUSTRIAL APPLICABILITY

-

Sequence List Free Text

What is claimed is:

1. A clothing management apparatus comprising:

a steam generation device configured to generate steam;

a steam discharge member configured to discharge the steam generated by the steam generation device to clothing;

a temperature sensor configured to detect a temperature in the clothing management apparatus; and a processor configured to:

based on a first clothing management start command being input, control the temperature detected by the temperature sensor to be stored in a memory, and control the steam generation device to perform a clothing management operation according to the detected temperature and the first clothing management start command, and based on a second clothing management start command being input within a preset period of time after performing the clothing management operations according to the first clothing management start command, control the steam generation device to perform a clothing management operation according to temperature information stored in the memory and the second clothing management command.

2. The clothing management apparatus according to claim 1, wherein the processor is configured to:

based on the temperature detected by the temperature sensor being within a preset range, control the steam generation device-lay using preset setting information, and based on the temperature detected by the temperature sensor being lower than the preset range, control the steam generation device using low temperature setting information different from the preset setting information.

3. The clothing management apparatus according to claim 2, wherein the low temperature setting information includes at least one of a starting pattern of a compressor of the steam generation device and an output steam temperature of the steam generation device.

4. The clothing management apparatus according to claim 1, wherein the clothing management apparatus includes a plurality of temperature sensors, and the processor is configured to determine a dried state of the clothing based on a difference between temperatures detected by the plurality of temperature sensors.

5. The clothing management apparatus according to claim 4, further comprising:

an air circulation device configured to circulate air of an accommodation space, wherein the plurality of temperature sensors includes:

a first temperature sensor at an inflow of the air circulation device, and a second temperature sensor positioned at a discharge of the air circulation device.

6. The clothing management apparatus according to claim 5, wherein the processor is configured to:

calculate a load size corresponding to a largest difference value from among differences between temperatures detected by the first temperature sensor and the second temperature sensor, and determine the dried state of the clothing based on the calculated load size.

7. The clothing management apparatus according to claim 4, wherein the processor is configured to adjust an operation time of a clothing management operation based on the determined dried state of the clothing.

* * * * *